United States Patent [19]

Peoples

[11] 4,245,817

[45] Jan. 20, 1981

[54] PNEUMATIC STAPLE REMOVER

[76] Inventor: Herman R. Peoples, Rte. 5, Box 510, Prattville, Ala. 36067

[21] Appl. No.: 69,847

[22] Filed: Aug. 27, 1979

[51] Int. Cl.[3] ..... B25C 11/00

[52] U.S. Cl. ..... 254/28

[58] Field of Search ..... 254/18, 28, 86 H; 81/5.1 R, 57.44

[56] References Cited

U.S. PATENT DOCUMENTS

| | | | |
|---|---|---|---|
| 1,957,151 | 5/1934 | Pollard | 254/86 H |
| 2,735,649 | 2/1956 | Swallert | 254/18 |
| 4,078,766 | 3/1978 | Saurwein | 254/18 |

*Primary Examiner*—Robert C. Watson

*Attorney, Agent, or Firm*—Harold C. Hogencamp

[57] ABSTRACT

An efficient fast-acting device for the removal of staples, particularly those driven into wood by staple guns. Energized by compressed air, thereby minimizing human work, effort and time. Especially useful to upholsterers.

4 Claims, 17 Drawing Figures

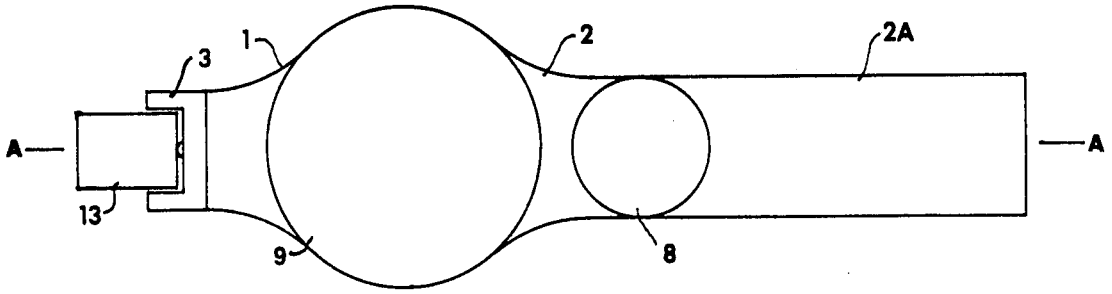
FIG. 1
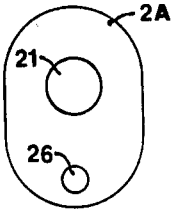
FIG. 2
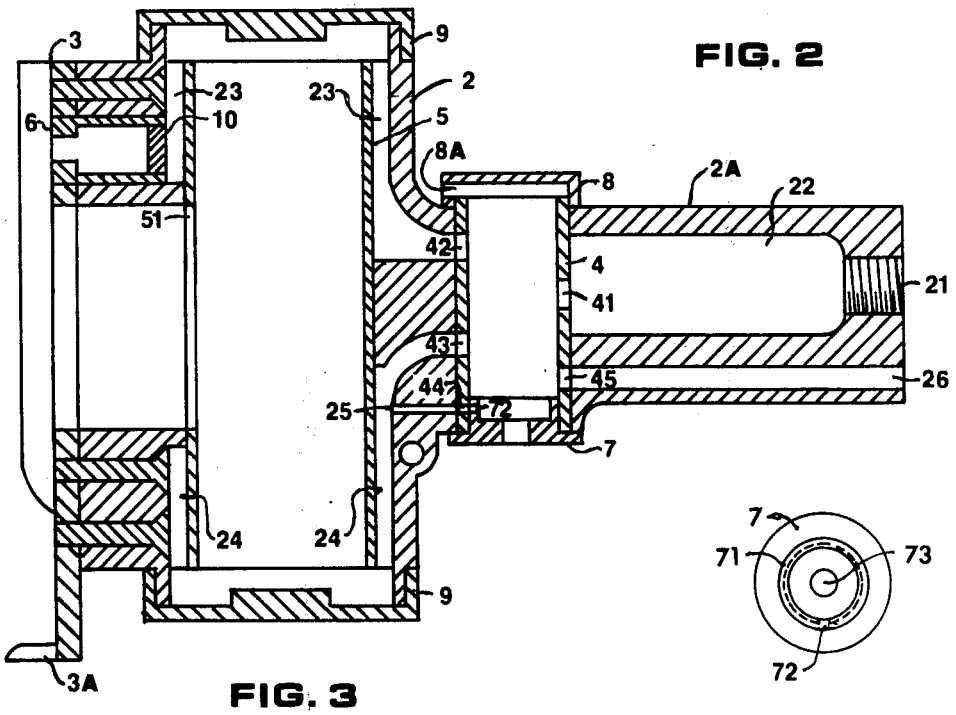
FIG. 3
FIG. 7
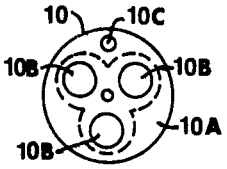
FIG. 4
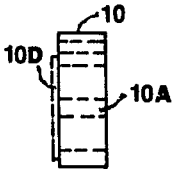
FIG. 5
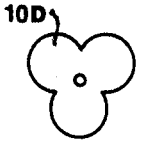
FIG. 6
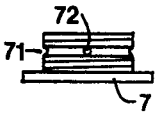
FIG. 8

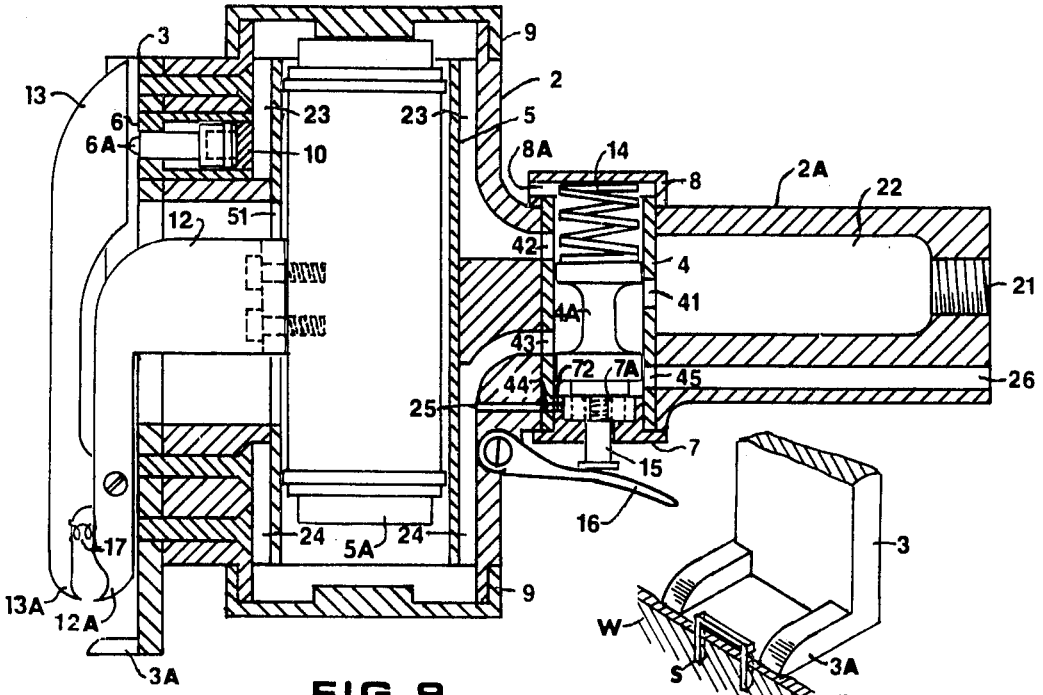
FIG. 9
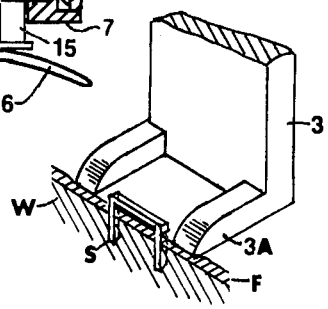
FIG. 9A
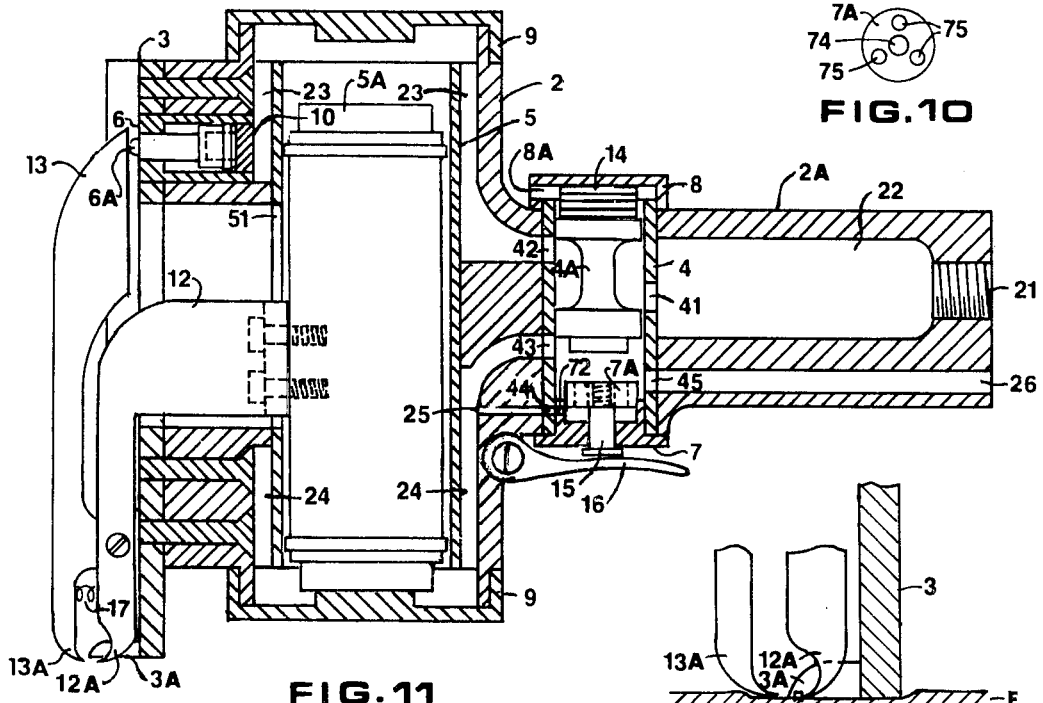
FIG. 11
FIG. 10
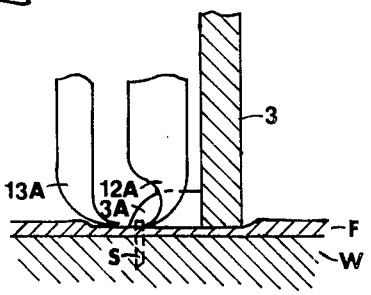
FIG. 11A

PNEUMATIC STAPLE REMOVER

The present invention relates to a device for the extraction or removal of staples. More particularly my device is operative by compressed-air to pull out staples which were driven in by a staple gun, especially those driven into wood. Since in operation the jaws of my device act to reach down and grab the staples; I term my device a staple grabber.

There is a real need for such a staple remover by professional furniture upholsterers. Before re-upholstering a piece of furniture the old upholstery material must be removed. This old material is generally held in place with staples driven into the wood frame by a staple gun. Literally hundreds of staples are sometimes employed in a single large piece of furniture, such as a davenport or the like. It becomes a tedious and timeconsuming job to remove such great numbers of staples by use of manually-operated staple removers, of which there are several types on the market.

Most of the staple removers available and listed in catalogs of upholstery tools are simple non-mechanical pry-bars which require human energy to "dig under" the staple and pull it out. One somewhat-improved type of extractor is a pliers-type tool disclosed in U.S. Pat. No. 3,241,814, but this tool too is hand-powered.

Other patents such as U.S. Pat. Nos. 2,570,914 and 2,709,570 and 4,078,766 disclose pneumatic nail pullers, none of them being suitable for extracting upholstery staples.

At the present time there appears to be no labor-saving, compressed-air energized, staple remover on the market to meet the need of the professional furniture upholsterer. My herein disclosed device does meet this need.

With the foregoing in mind, the primary object of my invention is to provide an efficient pneumatic device for the removal of staples, particularly those imbedded in wood.

A second object is to provide a staple pulling device of particular usefulness to upholsterers.

Other objects will become apparent from the following description together with the accompanying drawing and the appended claims.

In the drawing:

FIG. 1 is a top plan view showing one preferred construction of my device.

FIG. 2 is a plan view showing the outer enclosed end of the handle portion of the device shown in FIG. 1.

FIG. 3 is a modified sectional side view, on line A—A, of the structure depicted in FIG. 1 showing only the fixed-position non-moving parts.

FIGS. 4, 5 and 6 are enlarged plan views showing details of a sub-assembly employed in the seep-valve portion of the FIG. 3 structure.

FIGS. 7 and 8 are plan views showing details of the trigger-valve-cap included in the FIG. 3 structure.

FIG. 9 is fundamentally a replica of FIG. 3 but with the added inclusion of all other operational components needed to complete the structure.

FIG. 9A is a fragmentary view illustrating the positioning of the device shown in FIG. 9 in relation to the staple to be pulled.

FIG. 10 is a top plan view showing details of the pop-valve included in the complete FIG. 9 structure.

FIGS. 11, 12 and 13 are operational views which include all of the structural components shown in FIG. 9.

FIGS. 11A, 12A and 13A are fragmentary views corresponding respectively with FIGS. 11, 12 and 13, which illustrate the action of the jaws during steps of operation.

More specifically in the drawing, in which like reference characters denote like parts:

Figure 12:
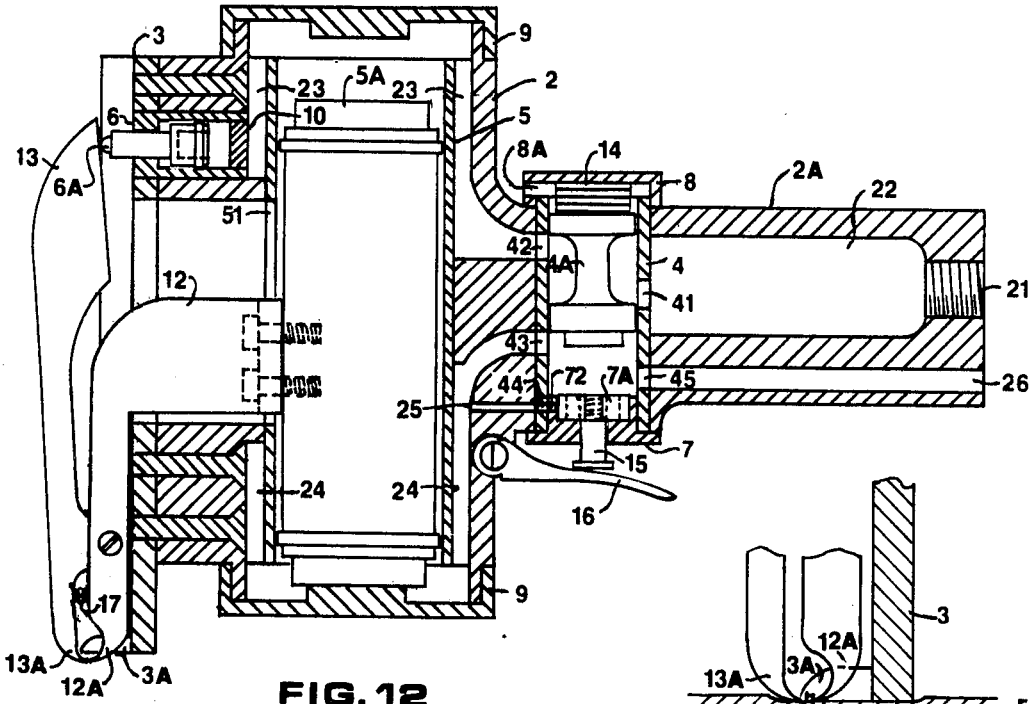

FIG. 1 shows the outer structure of one preferred embodiment of the staple remover 1 as viewed from the top. In this FIG. the outer housing 2 with its handle portion 2A is the prime visible component; exhaust-cap 8 and compression cap 9 being shown atop of housing 2. Also, firmly affixed to housing 2 at its front end and acting to complete the air-tight enclosure for the operative components of device 1 is the top view of puller-bar guide 3. The top view of grabber bar 13 is also shown in this FIG.

FIG. 2 shows the closed end of handle portion 2A of housing 2, including threaded compressed-air intake-opening 21 and lower air-exhaust opening 26.

In FIG. 3 not only the outer structure shown in FIG. 1—housing 2 with handle portion 2A, exhaust cap 8, pressure cap 9, puller-guide-bar 3 (with foot 3A)—but all other non-movable stationary parts and components of the device are shown in cross-section. These additional fixed non-movable components are: Trigger-valve-cylinder 4, piston-cylinder 5, seep-valve-sleeve 6 with its end-plug assembly 10, trigger-valve cap 7, trigger-valve exhaust-cap 8 with upper exhaust opening 8A, and top and bottom pressure-caps 9—9.

Additionally, the compressed-air-passages and compartments internal of housing 2 are shown, including: threaded compressed-air inlet 21, air-reservoir 22, upper air-passage 23, lower air-passage 24, pop-valve air-passage 25 and exhaust air-passage 26. Also holes or apertures in trigger-valve cylinder 4, corresponding with and alined with their respective air-passages; reservior-aperture 41, upper air-passage aperture 42, lower air-passage aperture 43, pop-valve air-aperture 44 and exhaust-air-aperture 45.

Piston cylinder 5 has a large opening 51 in one side, the purpose of which will become apparent in FIG. 9.

The upper portion of top air-passage 23 and the lower portion of bottom air-passage 24 completely encircle piston-cylinder 5 as is indicated by showing such portions on both sides of cylinder 5.

FIGS. 4, 5 and 6 are enlarged plan views of the seep-valve-end-assembly 10; FIG. 4 being an outer face view of the complete assembly, particularly showing like-holes 10B, 10B, 10B and smaller hole 10C in end-plug 10A; FIG. 5 is a side view of the assembly 10, and FIG. 6 is a face view of butterfly portion 10D.

FIGS. 7 and 8 are respectively top and side plan views of trigger-valve cap 7. In these FIGS. it is shown that there is a groove 71 extending completely around the outer threaded portion of trigger-cap 7. In at least one point in said groove 71 is a hole 72 piercing the outer peripheral wall of valve-cap 7. Center hole 73 is for the passage of the shank of trigger button 15.

FIGS. 9, 11, 12 and 13 are operational views in which the movable operational components have been added to the cross-section skeletal structure shown in FIG. 3.

In these FIGS. the movable components are shown in full form, not in cut-away cross-section, and include trigger-valve 4A, valve-spring 14, piston 5A, seep-valve 6A, and pop-valve 7A which is firmly attached to trigger-button 15, operative by trigger-level 16. The assembly of puller-bar 12 with its jaw 12A, grabber bar 13 with its jaw 13A, and puller spring 17 completes the device.

FIG. 10 is a top view of pop-valve-insert 7A showing center opening or hole 74 which is threaded to receive the cooperating threaded end of trigger-button 15, and three air passages or holes 75, 75, 75 which extend therethrough.

The fragmentary views of FIGS. 9A, 11A, 12A and 13A envisage the positioning of foot 3A and the relationship of jaws 12A and 13A with staple S, upholstery material or fabric F and wood frame W at the different operational steps involved in removing a staple corresponding with FIGS. 9, 11, 12 and 13.

Operation of the staple removing device 1 is as follows, reference being made to the operational and the detail FIGS. of the drawing:

FIG. 9 shows the positioning of the various movable, operational components of the device when it is connected through threaded air-intake opening 21 to the external compressed-air supply; reservoir 22 being thereby filled with compressed air, and the device being ready for operation.

As shown in this FIG., pop-valve 7A (face view shown in FIG. 10) is seated in trigger-valve end-cap 7 and trigger button 15, attached to pop-valve 7A, is at its outermost position as is trigger lever 16; Trigger valve 4A is at the bottom end of cylinder 4, resting on pop-valve 7A and with spring 14 expanded and pressing down on it from the top. Piston 5A is at its uppermost position in cylinder 5, being held there by the compressed-air passing through the open air-path extending from reservoir 22 through aperture 41, around the contoured middle portion of trigger valve 4A, through aperture 43 and lower air-passage 24, through space in lower pressure-cap 9, and into the open lower cavity of cylinder 5 under piston 5A, and then pressing upward on the bottom of piston 5A.

It is to be realized that the compressed-air from reservoir 22 only surges through this lower open air path for the nearly-instantaneous time it initially takes to equalize the compressed-air pressure in the entire lower air-space thus open to reservoir 22: (including also pop-valve air passage 25). This equalized compressed-air pressure is then maintained, but without further need of actual air flow. During the initial surge of compressed-air before reaching equalized pressure the blast of compressed-air acts to push downwardly against the lower inner-rim portion of trigger-valve 4A. When the pressure is equalized, upward and downward pressure on the inner rim of trigger-valve is also equalized and only the spring 14 holds the trigger-valve down. (Any gravity effect is minimized by the friction between air-tight trigger-valve 4A and trigger-cylinder 4.)

In this condition the upper air-passage 23 and the upper cavity of cylinder 4, above trigger-valve 4A are open to the atmosphere through the opening 8A in exhaust-cap 8 and are depressurized. The assembly of puller arm 12 and grabber arm 13 is held in its' upper position, being firmly attached to the side of piston 5A through the large opening 51 in one side of piston cylinder 5 as is clearly shown in the drawing. Jaws 12A and 13A of puller arm 12 grabber arm 13 are in an open position as shown, and are held open by expanded arm-spring 17 which also acts through grabber arm 13 to hold seep-valve 6A inwardly in seep-valve sleeve 6.

Until trigger lever 16 is pressed inward to activate the device and so long as incoming air-pressure is maintained, all components will remain in the positions shown in FIG. 9 and the device itself will be ready for use.

To extract a staple the readied device of FIG. 9 is then placed so that foot 3A is in proper relationship with the staple S as illustrated in FIG. 9A. Jaws 12A and 13A will be in the raised and separated condition shown in FIG. 9.

The entire operation of extracting a staple takes only in the order of one-half a second in time after properly positioning the device, as in FIG. 9A, and pressing trigger-lever 16.

When trigger lever 16 is pressed inward, as in FIG. 11, pop-valve 7A is mechanically raised by trigger button 15 from its seated position in end-cap 7 and this opens pop-valve air-passage 25 by way of aperture 44 and hole 72 (or groove 71 and hole 72) in trigger-valve cap 7. As air-passage 25 is opened a blast of compressed-air is released under pop-valve 7A, passing upward through the holes or openings 75, 75, 75 therein (see details of end-cap 7 in FIGS. 7 and 8 and of pop-valve 7A in FIG. 10). The upward surge of air presses upward against the bottom of trigger-valve 4A, overcoming the downward pressure of spring 14 on its top. This quick blast of air pressure occurs while lower air-passage 24 is still pressurized, as in FIG. 9, and before there is a change in air paths.

Trigger-valve 4A almost instantly is forced to its uppermost position in cylinder 4.

As trigger-valve 4A moves upwardly in cylinder 4 it first closes aperture 43 to lower air-passage 24; then opens aperture 43 and air passage 24 to the cavity in cylinder 4 which occurs beneath trigger-valve 4A and thus opens the air-path through aperture 45 to exhaust passage 26, de-pressurizing the cavity in piston cylinder 5 beneath piston 5A and removing the upward air-pressure against the bottom of piston 5A. Instantly the pressurized-air is released and flows until atmospheric pressure is reached. At substantially this same time the upward movement of trigger-valve 4A, caused by the upward pressure of air coming through pop-valve air passage 25, opens the air path through opening 42 in cylinder 4 to upper air-passage 23 and closes the air path from air-passage 23 into the upper cavity in cylinder 4 and trigger-valve exhaust cap 8.

Under this condition, compressed-air from reservoir 22, passing through the central portion of trigger-valve 4A as before, surges through upper air passage 23, through compression cap 9, into the upper end of piston cylinder 5, and presses downwardly on the top of piston 5A, driving it down in cylinder 5 and, with it, the puller bar 12 and grabber bar 13 assembly which is firmly attached to piston 5A.

Jaws 12A and 13A of puller bar 12 and grabber bar 13 are thereby driven downwardly, penetrating through the upholstery material F to a position lower than the flat horizontal top portion of the staple S as illustrated in FIG. 11A: jaws 12A and 13A still being separated from each other in an open condition as shown, by reason of bar-spring 17 and the delayed-action of of seep-valve 6A.

In describing this delayed action of seep-valve 6A, reference is made to FIGS. 4, 5 and 6 showing details of the end-insert assembly 10 which is firmly emplaced in seep-valve sleeve 6, as is shown in FIGS. 9, 11, 12 and 13.

Assembly 10 comprises plug section 10A having three holes 10B, 10B, 10B and a smaller hole 10C therethrough. Affixed to the inner face of plug 10A is a "butterfly" section 10D preferably made of thin spring material such as spring brass or the like. Butterfly section 10D is firmly attached at its center and with the three symmetrical portions which cover the three holes 10B, 10B, 10B being held flat against the inner face of plug 10A but free to spring or bend slightly outwardly from it.

In operation: During the initial inflow of compressed-air through top air passage 23 the expanded bar-spring 17, acting through grabber-bar 13, presses seep-valve 6A inwardly in sleeve 6 and against the inner face of end-insert assembly 10; holes 10B, 10B, 10B are covered on their inner side by the spring action of butterfly 10D. Only the smaller hole 10C is open and this allows a very restricted path for air into the interior of seep-valve sleeve 6 and hollow seep-valve 6A. Therefore, in this first surge, the compressed-air takes the easiest path—into the top cavity of piston cylinder 5. This presses piston 5A downward since the lower cavity portion of cylinder 5, under piston 5A, is now at or nearing atmospheric pressure.

Figure 12A:
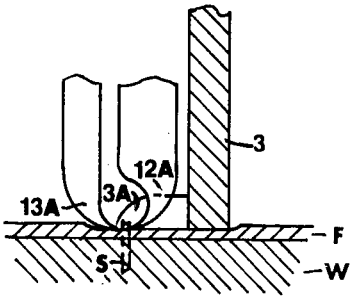

An instant later, at approximately the time when the air-pressure in the top (expanded) cavity in cylinder 5 has reached its maximum, the peak air-pressure overcomes the opposition of butterfly 10D and spring 17 and thereby opens the air-path through holes 10B, 10B, 10B and forces seep-valve 6A outward. This outward movement of seep-valve 6A acts through grabber-arm 13 to move jaw 13A toward jaw 12A and the jaws close under the flat top of the staple to be pulled as indicated in FIGS. 12 and 12A. The positioning of all other movable components remains as in FIG. 11.

During the period when the compressed-air is moving into the upper air-space and is pushing down piston 5A and the puller arm 12 and grabber-arm 13 assembly affixed to it, the incoming stream of air through the central open-portion of trigger-valve 4A presses upward on the upper inner-rim of valve 4A enough to overcome the downward pressure of spring 14, even for an instant after trigger-lever 16 has been released.

Figure 13:
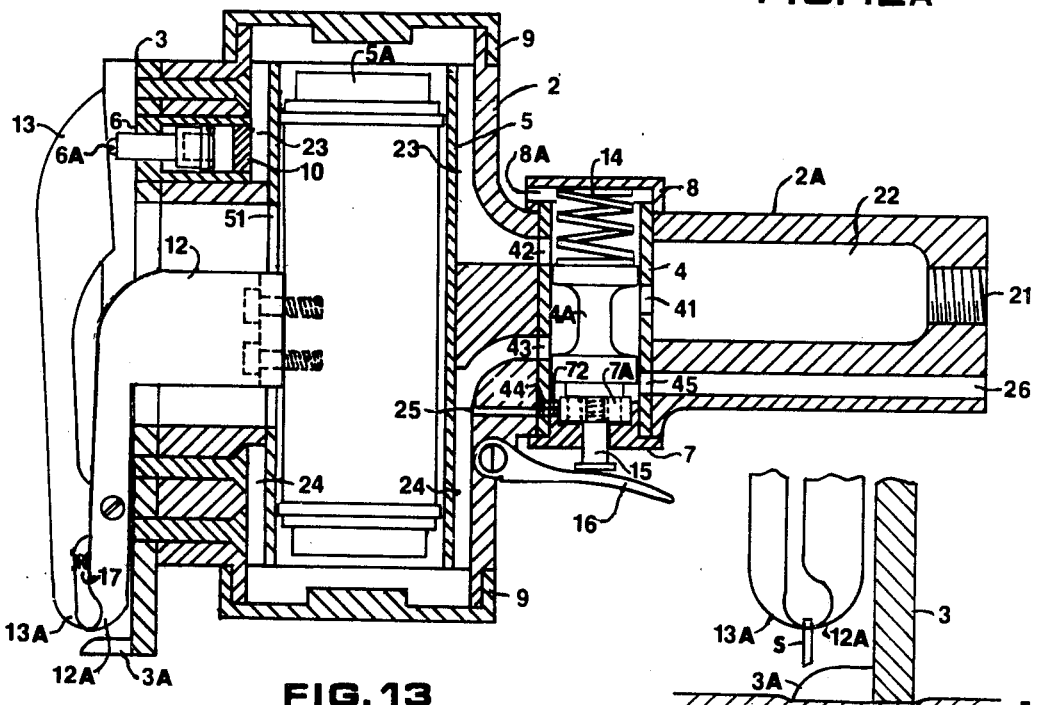

However, when the pressure has equalized at a maximum and there is no longer a flow of pressurized air into upper air-passage 23 the upward pressure in trigger-valve 4A is relaxed and spring 14 then acts to press trigger-valve 4A downward to the position shown in FIG. 13.

As trigger-valve 4A moves downward past aperture 42 in cylinder 4 the air-path from the top cavity of cylinder 4, above the downward-moving trigger-valve 4A, and thence through opening 8A in exhaust cap 8 into the outer air and the entire upper air-space is depressurized.

Almost instantly thereafter, as trigger-valve 4A continues its downward movement, the air-path from reservoir 22, through the central portion of trigger-valve 4A is opened through aperture 43 into lower air-passage 24 and thence through the interior of pressure cap 9 into the lower cavity of piston-cylinder 5 where the compressed-air stream presses upward on the bottom of piston 5A. This acts to quickly raise piston 5A in cylinder 5; raising attached puller bar 12 and grabber bar 13 assembly with it as indicated in FIG. 13, and pulling out the staple S as illustrated in FIG. 13A.

Nevertheless, as quick as is this action, there is a slight delay in the ensuring reaction of seep-valve 6A.

Not only the inner cavity of seep-valve sleeve 6, with the valve 6A in its outward position, but also the space within the hollow seep-valve 6A itself is filled with compressed air at the start of this phase of operation. This open chamber can only be depressurized by flow of air through the small hole 10C in end-cap 10A and such air-pressure release can only occur after or as the air-pressure in the top cavity in piston cylinder 5, the air-passage 23, and the upper cavity in trigger-valve cylinder 4 is reduced.

Figure 13A:
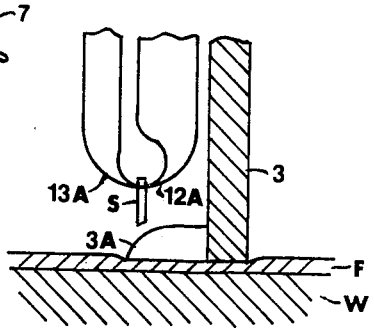

Therefore there is enough time delay in the action of seep-valve 6A so that the jaws 12A and 13A, activated by seep-valve 6A, will not open and release the staple until after it is pulled and raised to a position above that such as illustrated in FIG. 13A.

When piston 5A reaches its uppermost point all components will again be positioned as shown in FIG. 9; a staple-pulling cycle will be completed and the device 1 will again be ready to repeat the operation and pull the next staple.

Reiterating, each complete cycle in the operation of removing a staple takes only about one-half a second (plus or minus) in time. Except for the slight hesitation during the reversal from down to up the complete action is substantially continuous. Obviously each phase of the operation takes only a fraction of the total time—only an "instant" of time.

It is to be realized that the actual physical structure of my device need not exactly coincide with the drawing and description included herein so long as the operative parts operate in the manner here disclosed.

Summarizing: It is to be noted that the space around the contoured central portion of spool-shaped trigger valve 4A is open to compressed-air reservoir 22 at all times by way of aperture 41 in the wall of trigger-valve cylinder 4.

As shown in FIGS. 9 and 13; when trigger-valve 4A is in its lower position this central air space in trigger-valve 4A is opened through aperture 43 and compressed-air from reservoir 22 flows into lower air-passage 24 and thence into the lower open end of piston cylinder 5, pressing upward on the bottom end of piston 5A. This raises piston 5A to its uppermost position and with it the puller-grabber bar assembly which is firmly attached to it, jaws 12A and 13A being held open by bar spring 17. In this condition aperture 42 is open to the top cavity of trigger-valve cylinder 4 and thereby provides a path through exhaust cap opening 8A to depressurize the upper air space of piston-cylinder 5, above piston 5A.

As shown in FIGS. 11 and 12; when trigger-valve 4A is in its upper or raised position the central air space in trigger-valve 4A is opened through aperture 42 and compressed-air from reservoir 22 flows into upper air-passage 23 and thence into the upper open end of piston-cylinder 5, pressing downward on the top end of piston 5A. This forcibly drives piston 5A to its lowermost position and with it the puller-grabber bar assembly which is firmly attached to it, jaws 12A and 13A being driven down below the flat top head of staple S. As better detailed in FIG. 11A jaws 12A and 13A are initially still held open from each other by bar-spring 17. After its slight delay seep-valve 6A then acts to close jaws 12A and 13A; jaw 13A being forced under the flat head of staple S to close with jaw 12A. In this condition aperture 43 is open to the bottom cavity of trigger-valve cylinder 4 and thereby provides a path through exhaust air-passage 26 to depressurize the lower air space of piston-cylinder 5, below piston 5A.

Thus as trigger-valve 4A is moved downwardly by spring 14 or upwardly by a blast of compressed-air through pop-valve 7A, initiated by trigger 15–16, it may be termed a reversing-valve since it acts to cause piston 5A and attached puller-grabber bar assembly to reverse up or down movement.

The scope of this invention is to be limited only by the appended claims.

Having thus disclosed my invention, what I claim as new and desire to protect by letters-patent is:

1. A pneumatic device for removing staples comprising, in combination: a staple-puller assembly consisting of a vertically-oriented elongated puller-bar terminating at its lower end in a jaw, a substantially parallel-positioned elongated grabber-bar terminating at its lower end in a jaw complementary to said puller-bar jaw, and spring means for holding said grabber-jaw separated from said puller-jaw; a piston-cylinder which is open at both its lower and its upper ends; a piston having closed bottom and top ends slidably mounted in said piston-cylinder and being firmly attached on one side to said staple-puller assembly; a compressed-air reservoir; an air passage between the lower open end of said piston-cylinder and said compressed-air reservoir; an air passage between the upper open end of said piston-cylinder and said reservoir; a slidable reversing-valve interposed between said lower and upper air passages and said reservoir; means for causing said reversing valve to alternately open and close said lower and upper air passages to said reservoir; means for causing said grabber-jaw to close with said puller jaw under the head of a staple; and trigger means for activating said device.

2. The device as set forth in claim 1 wherein said compressed-air reservoir is open at one end to the compressed-air input through a passage unobstructed by a valve.

3. The device as set forth in claim 1 wherein said means for causing said grabber-jaw to close with said puller jaw under the head of a staple comprises a pneumatic seep-valve.

4. The device delineated in claim 3 wherein said pneumatic seep-valve also acts to separate said jaws after staple is pulled.

* * * * *